US012708192B2

(12) United States Patent
Joseph

(10) Patent No.: US 12,708,192 B2
(45) Date of Patent: Aug. 18, 2026

(54) BODY-WORN SMART DEVICE HOLDING APPARATUS

(71) Applicant: Woodens Bernard Joseph, Baldwin, NY (US)

(72) Inventor: Woodens Bernard Joseph, Baldwin, NY (US)

( * ) Notice: Subject to any disclaimer, the term of this patent is extended or adjusted under 35 U.S.C. 154(b) by 158 days.

(21) Appl. No.: 18/359,994

(22) Filed: Jul. 27, 2023

(65) Prior Publication Data

US 2024/0065422 A1 Feb. 29, 2024

Related U.S. Application Data

(60) Provisional application No. 63/401,413, filed on Aug. 26, 2022.

(51) Int. Cl.

| | |
|---|---|
| ***A45F 3/14*** | (2006.01) |
| ***A45F 3/00*** | (2006.01) |
| ***A45F 5/00*** | (2006.01) |

(52) U.S. Cl.

CPC ..... *A45F 3/14* (2013.01); *A45F 2003/003* (2013.01); *A45F 2003/142* (2013.01); *A45F 5/1525* (2025.01)

(58) Field of Classification Search

CPC ..... A45F 3/14; A45F 5/1508; A45F 5/1516; A45F 5/1525; A45F 5/1533

USPC ..... 224/623, 264

See application file for complete search history.

(56) References Cited

U.S. PATENT DOCUMENTS 5,318,084 A * 6/1994 Jackson ..... A45F 3/00 224/264
5,323,942 A * 6/1994 Dahan ..... A45F 5/00 224/907
D378,163 S * 2/1997 Clissold ..... D3/218

(Continued)

FOREIGN PATENT DOCUMENTS

WO WO-2020148655 A1 * 7/2020 ..... A62B 35/0037

OTHER PUBLICATIONS

WO-2020148665-A1; "Safety Harness With Removable Rigid Dorsal Force-Transfer Member"; Safe, Nathan; Jul. 23, 2020; (Year: 2020).*

(Continued)

*Primary Examiner* — Nathan J Newhouse
*Assistant Examiner* — Lester L Vanterpool
(74) *Attorney, Agent, or Firm* — Brennan, Manna & Diamond, LLC

(57) ABSTRACT

The present invention relates to a multipurpose tablet and personal documents holding apparatus. The apparatus includes a padded or impact absorbent case for accommodating a tablet and one or more documents through a slit at the top end thereof, a pair of shoulder straps for securing the apparatus on the shoulders of a user and a pair of bottom straps for crossing around the back of the user to releasably fasten to the shoulder straps. A back strap is fastened at the back of the user using a buckle system such that the padded or impact absorbent case is positioned on the torso or chest of a user for easy accessibility of the tablet and documents. The shoulder straps have pockets for securing personal documents and items. The padded or impact absorbent case and the pockets are water-resistant and securely store the tablet and personal documents of a user.

15 Claims, 9 Drawing Sheets

(56) References Cited

U.S. PATENT DOCUMENTS 5,797,142 A * 8/1998 Debronsky, Jr. ..... A45F 5/02 15/208
5,961,014 A * 10/1999 Knerr ..... A45F 3/04 224/259
6,006,970 A 12/1999 Piatt
D429,564 S * 8/2000 Carver ..... D3/226
6,149,305 A * 11/2000 Fier ..... A45F 3/04 383/85
6,220,493 B1 * 4/2001 Iijima ..... A45F 3/02 224/153
6,790,201 B2 * 9/2004 Meyer ..... A61M 25/02 604/179
D685,988 S * 7/2013 Shepherd ..... D3/217
8,657,166 B1 * 2/2014 Harness ..... A45F 3/14 224/259
8,844,448 B2 9/2014 Allen
8,960,511 B2 * 2/2015 Shepherd ..... A45F 3/14 442/205
9,923,590 B1 * 3/2018 Picking ..... H04B 1/385
10,182,639 B2 * 1/2019 Picking ..... A45F 3/14
10,944,140 B2 * 3/2021 Thiel ..... H01M 50/105
11,033,092 B2 * 6/2021 Prudente ..... A45F 3/04
11,110,307 B1 * 9/2021 Possible ..... A62B 25/00
11,304,500 B2 * 4/2022 Thiel ..... A45F 3/06
11,672,322 B1 * 6/2023 Mulhearn ..... A45F 3/04 224/671
2007/0170219 A1 * 7/2007 Ballarta ..... A45F 3/04 224/645
2009/0272779 A1 11/2009 Vu
2011/0309124 A1 * 12/2011 Dubois ..... A45F 3/04 224/628
2012/0061549 A1 3/2012 Rogers
2012/0248160 A1 * 10/2012 Seimetz ..... A45F 5/00 224/183
2013/0047312 A1 * 2/2013 Wilson ..... A41D 13/0012 2/69
2015/0208789 A1 * 7/2015 Pylkovas ..... A45C 3/02 224/607
2015/0223590 A1 8/2015 Arias-Tabima
2015/0305478 A1 * 10/2015 Krol ..... A45F 5/021 224/148.6
2017/0229692 A1 * 8/2017 Thiel ..... A41D 31/085
2018/0020791 A1 * 1/2018 Cole ..... A45F 3/02 224/576
2018/0235352 A1 * 8/2018 Jones ..... A41D 15/04
2023/0098235 A1 * 3/2023 Anguiano ..... G09F 21/02 224/600

OTHER PUBLICATIONS

CN-208264860-U; "A Medicine Antibacerial Storage Tank"; Xiaoyan, Shi; China; Dec. 21, 2018 (Year: 2018).*
CN-211919517-U; "Fertilizer Packaging Bag With Good Moisture-Proof Performance"; Cheng, Cen; China; Nov. 13, 2020 (Year: 2020).*
ES 1136606 U; Pera, Gallemi J., "Protective Case for Mobile Device, Such as Mobile Phone, Tablet or Video Game Console, Has a Surface That Has Inner and Outer Layers Made of Woven Body of Polyester Microfibers and Intermediate Layer That Has Absorbent for Absorbing Impacts" Feb. 23, 2015 (Year: 2015).*

* cited by examiner

BODY-WORN SMART DEVICE HOLDING APPARATUS

CROSS-REFERENCE TO RELATED APPLICATION

The present application claims priority to, and the benefit of, U.S. Provisional Application No. 63/401,413, which was filed on Aug. 26, 2022, and is incorporated herein by reference in its entirety.

FIELD OF THE INVENTION

The present invention relates generally to the field of smart device holder apparatuses. More specifically, the present invention relates to a novel multipurpose electronic tablet holding apparatus capable of being used by prison inmates to prevent damage to their prison tablets and personal documents. The apparatus utilizes a padded or impact absorbent case to fully protect and hold the electronic tablet and features a plurality of straps with adjustable buckles to accommodate individuals of different body types. Accordingly, the present disclosure makes specific reference thereto. Nonetheless, it is to be appreciated that aspects of the present invention are also equally applicable to other like applications, devices, and methods of manufacture.

BACKGROUND

By way of background, inmates of prisons and other institutions live without physical presence of their friends and families and have limited interaction with outsiders which can lead to mental health issues and irrational behavior. Various communication systems are used to enable inmates to talk with loved ones, friends, and others who are outside of the institution. One example of such communication devices or systems is Global Tel Link (GTL) tablets that provide means for communication, entertainment, efficiency, and education solution to correctional facilities. Such electronic devices help calm the corrections environment, resulting in an inmate population that is more tranquil, less anxious, and less aggressive. The communication devices for inmates are especially designed and manufactured, and tend to be expensive. These high-tech devices are similar to common handheld electronic tablets but are made exclusively by Global Tel Link. Electronic tablets offer specialized content and services for inmates to use during their confinement at correctional facilities. The electronic tablets enable inmates access to a suite of education and entertainment content, plus the ability to place phone calls, send messages, and get general on-site support. Some tablet content and services are free, such as select reading material, utilities (dictionary, calendar, calculator, etc.), and quick links to common facility tools.

Inmates generally keep their communication or electronic devices in their pockets or in their hands, which can easily damage the devices. Physical damage due to a fall or excessive bending is also common which can lead to cracked, broken, or bleeding display along with hardware malfunctions. While doing physical activities, devices are kept at a common place which often leads to the devices being stolen or unintentionally mixed with other inmate's devices. Due to unavailability of holding systems of such devices, inmates and even administrators find it difficult to securely store the devices. There is a common need for a holding system that can securely and conveniently hold inmate personal communication or electronic devices to prevent damage.

Documents such as personal documents, money, and other physical items are difficult to store by inmates and are often lost. Inmates and authorities desire a holding system for storing such documents in a convenient manner.

Storing tablets or communication devices and documents at a central place, such as a wall mounted cabinet or kiosk, is often discomforting and time consuming. Further, this limits the use of communication devices and inmates may end up not using their devices and documents.

Therefore, there exists a long-felt need in the art for an inmate electronic tablet holding system for securely storing prison tablets and other documents. There is also a long-felt need in the art for a multipurpose tablet holding apparatus that can be secured to the body of a user to keep the tablet and documents nearby. Additionally, there is a long-felt need in the art for a multipurpose communication device holding apparatus that prevents an inmate's tablet and documents from falling causing physical damage. Moreover, there is a long-felt need in the art for a holding case to hold a tablet or smart device in a water-resistant manner. Further, there is a long-felt need in the art for a unique holding device designed specially to hold a prison tablet and documents and that can be adhered to the body of a user. Furthermore, there is a long-felt need in the art for a prison tablet holding device that protects the tablet from physical damage while obviating the need to store the tablet at a common and faraway place. Finally, there is a long-felt need in the art for a unique electronic tablet holding device that offers a way for prison inmates to protect their belongings such as, for example, a provided GTL (i.e., prison) tablet and documents while incarcerated.

The subject matter disclosed and claimed herein, in one embodiment thereof, comprises a multipurpose electronic tablet holding apparatus. The apparatus is in the form of a tool that enables a user to secure a tablet or smart device to their body. Preferably, the apparatus is designed to hold tablets and documents of prison inmates. The apparatus comprising of a padded (i.e., padded layers) or impact absorbent case for accommodating the smart device/tablet and a plurality of pockets for securely storing documents and small items is disclosed. The padded or impact absorbent case has a slit at the top end for accommodating and accessing the tablet therein and has a clear cover enabling the user to operate and view the tablet without removing the apparatus. For securing the apparatus to the body of a user, the apparatus has a pair of shoulder straps attached to the top end of the padded or impact absorbent case and a pair of bottom straps attached to the bottom end of the padded or impact absorbent case such that a shoulder strap is releasably fastened to a corresponding bottom strap at the back portion of the user wherein the fastening takes place at the back of the user. A back supporting strap attached to the padded or impact absorbent case and configured to wrap around the back of the user for securing the padded or impact absorbent case. The straps are adjustable in length and the padded or impact absorbent case is water-resistant to fully protect and hold the tablet.

In this manner, the electronic tablet holding apparatus of the present invention accomplishes all of the foregoing objectives and provides users with a tablet holding system, capable of being used by prison inmates to prevent damage to their prison tablets and personal documents. The apparatus enables the users to wear the apparatus using adjustable straps to keep their tablets and personal items close by. The device prohibits physical damage and stealing of the devices in correction facilities.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a multipurpose electronic tablet holding apparatus. The apparatus is in the form of a tool that enables a user to secure a tablet or smart device to their body. The apparatus comprising of a padded (i.e., padded layers) or impact absorbent case for accommodating the smart device/tablet and a plurality of pockets for securely storing documents and small items is disclosed. A pair of shoulder straps are attached to the top end of the padded or impact absorbent case and a pair of bottom straps are attached to the bottom end of the padded or impact absorbent case such that a shoulder strap is releasably fastened to a corresponding bottom strap at the back portion of the user. A back supporting strap attached to the padded or impact absorbent case is configured to wrap around the back of the user for securing the padded or impact absorbent case. The padded or impact absorbent case has a slit at the top end for accommodating and accessing the tablet therein and has a clear cover enabling the user to operate and view the tablet without removing the apparatus.

In yet another embodiment, the back strap, the shoulder straps, and the bottom straps are adjustable in length and are made of nylon webbing.

In yet another embodiment, the shoulder straps have padded support for comfort and pockets for storing personal documents.

In yet another embodiment, an apparatus for securely storing a prison tablet near to the body of a prisoner is disclosed. The apparatus is designed to be worn on the torso of a prisoner and features a padded or impact absorbent case for accommodating a prison tablet and has a clear cover enabling a prisoner to view and operate the tablet therethrough. The apparatus further has a right shoulder strap and a left shoulder strap sewn to the top end of the padded or impact absorbent case, a right bottom strap and a left bottom strap sewn to the bottom end of the padded or impact absorbent case, the left shoulder strap is releasably fastened to left bottom strap at the back of the user wearing the apparatus, the right shoulder strap is releasably fastened to right bottom strap at the back of the user wearing the apparatus, a back strap is configured to wrap around the back of the user such that the padded or impact absorbent case is positioned on the torso of the user. The padded or impact absorbent case fully protects and holds the tablet, and the straps obviate requirement of the user to manually hold the case.

In yet another embodiment, the straps feature adjustable buckles to accommodate individuals of different body types and sizes of users.

Numerous benefits and advantages of this invention will become apparent to those skilled in the art to which it pertains upon reading and understanding of the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
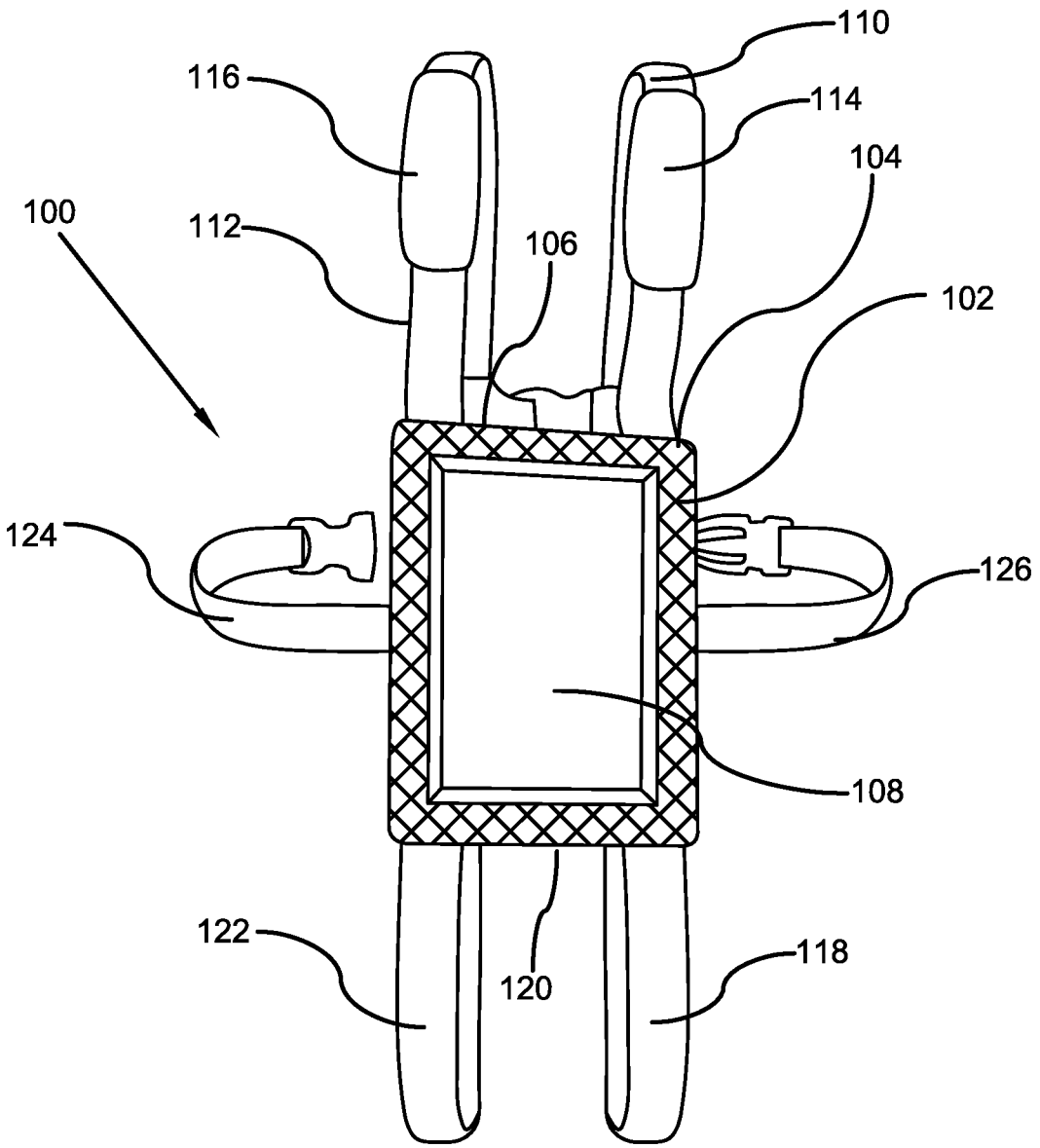
FIG. 1 illustrates a front perspective view of one potential embodiment of a prison tablet holding apparatus of the present invention in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown.

Thus, in other embodiments, any of the features described herein from different embodiments may be combined.

As noted above, there is a long-felt need in the art for an inmate electronic tablet holding system for securely storing prison tablets and other documents. There is also a long-felt need in the art for a multipurpose tablet holding apparatus that can be secured to the body of a user to keep a tablet and documents nearby. Additionally, there is a long-felt need in the art for a multipurpose communication device holding apparatus that prevents an inmate's tablet and documents from falling causing physical damage. Moreover, there is a long-felt need in the art for a holding case to hold a tablet or smart device in a water-resistant manner. Further, there is a long-felt need in the art for a unique holding device designed specially to hold a prison tablet and documents that can be adhered to the body of a user. Furthermore, there is a long-felt need in the art for a prison tablet holding device that protects the tablet from physical damage while obviating the need to store the tablet at a common and faraway place. Finally, there is a long-felt need in the art for a unique electronic tablet holding device that offers a way for prison inmates to protect their belongings such as a provided (i.e., GTL) tablet and documents while incarcerated.

The present invention, in one exemplary embodiment, is an apparatus for securely storing a prison tablet near to the body of a prisoner. The apparatus features a water-resistant padded (i.e., padded layers having a plastic underlayer) or impact absorbent case for accommodating a tablet or smart device and has a clear cover enabling a prisoner to view and operate the screen of the tablet while the smart device is still in the cover. The apparatus further has a right shoulder strap and a left shoulder strap sewn to the top end of the padded or impact absorbent case, a right bottom strap and a left bottom strap sewn to the bottom end of the padded or impact absorbent case, the left shoulder strap is releasably fastened to left bottom strap at the back of the user while wearing the apparatus, the right shoulder strap is releasably fastened to right bottom strap at the back of the user while wearing the apparatus, a back strap is configured to wrap around the back of the user such that the padded or impact absorbent case is positioned on the torso of the user.

Referring initially to the drawings, FIG. 1 illustrates a front perspective view of one potential embodiment of a prison electronic tablet holding apparatus of the present invention in accordance with the disclosed architecture. The prison tablet holding apparatus 100 of the present invention is designed to securely store an electronic tablet or any other similar smart device therein and has a plurality of straps to wrap around the body of a user such that the stored smart device is kept close to a user's body in a secure manner. More specifically, the apparatus 100 is water-resistant and has a padded (i.e., padded layers having a plastic underlayer) or impact absorbent case 102 for accommodating a smart device. The padded or impact absorbent case 102 has a slit 104 at the top end 106 thereof for inserting the tablet therethrough to enable storage of the tablet inside the case 102. The front surface 108 of the padded or impact absorbent case 102 is clear or transparent thereby enabling a user to view the display of the smart device and use the smart device while the device is stored in the padded or impact absorbent case 102.

Figure 4:
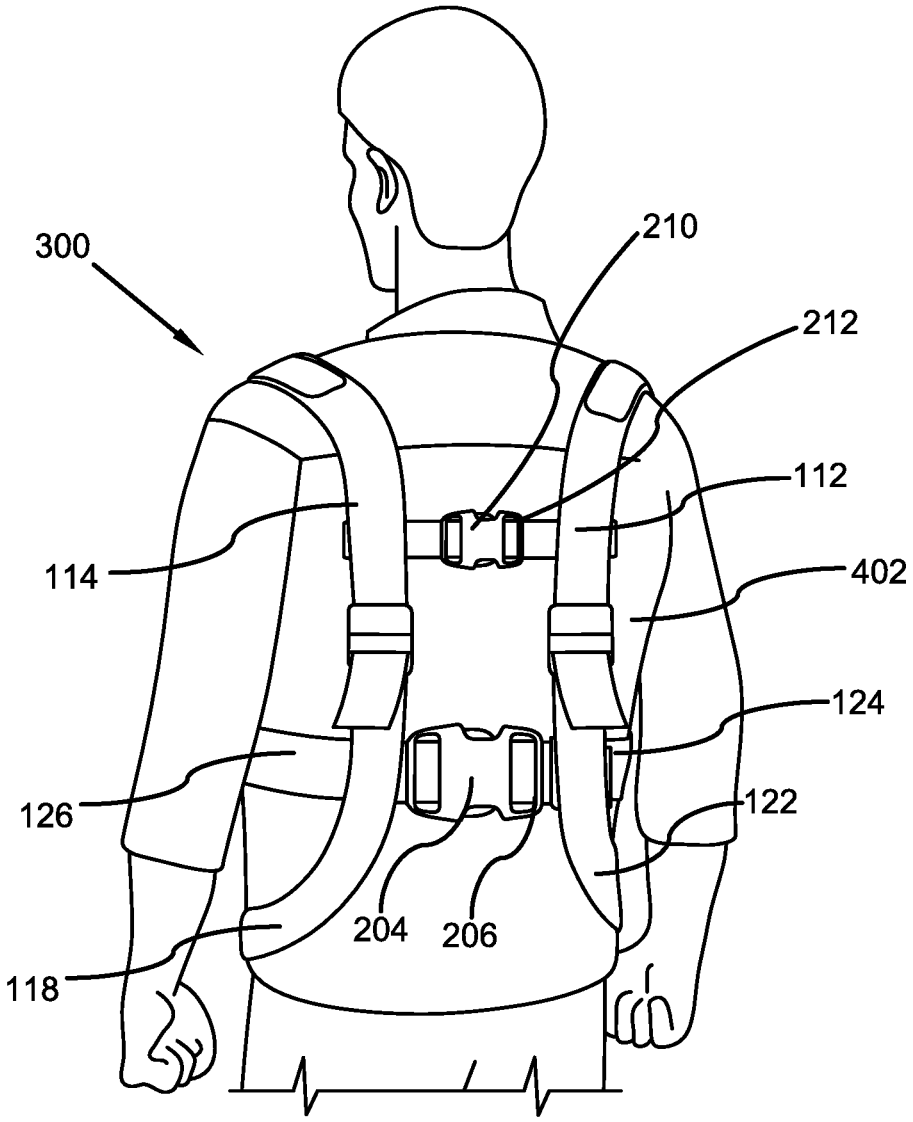
FIG. 4 illustrates a rear perspective view of the user wearing the electronic tablet holding apparatus of the present invention in accordance with the disclosed architecture.

The padded or impact absorbent case 102 is water-resistant and protects the stored smart device from inclement weather. A pair of shoulder straps 110, 112 are attached (such as sewn) to the top end 106 of the padded or impact absorbent case 102 and are configured to extend across or over the shoulder from the front of the shoulders of a user to the back of the shoulders. The left shoulder strap 110 has a cushioned shoulder pocket 114 for storing personal documents and small items. Similarly, the right shoulder strap 112 has a cushioned shoulder pocket 116 for storing personal documents and small items. It is to be appreciated that pockets 114, 116 are selectively detachable. The shoulder straps 110, 112 are adjustable in length to fit around shoulders of different sized users. For securing the left shoulder strap 110 around the shoulder and at the back of a user of the device 100 as shown in FIG. 4, a left bottom strap 118 is attached to the bottom end 120 of the padded or impact absorbent case 102. The left bottom strap 118 is adjustable in length and is configured to releasably fasten to the left shoulder strap 110.

For securing the right shoulder strap 112 around the right shoulder and at the back of the user using the device 100, a right bottom strap 122 is attached to the bottom end 120 of the padded or impact absorbent case 102. The right bottom strap 122 is adjustable in length and is configured to releasably fasten to the right shoulder strap 112. The shoulder straps 110, 112 and the bottom straps 118, 122 are configured to enable a user to secure the tablet holding device 100 like a backpack with the padded or impact absorbent case 102 accessible in front of a user's body.

Figure 2:
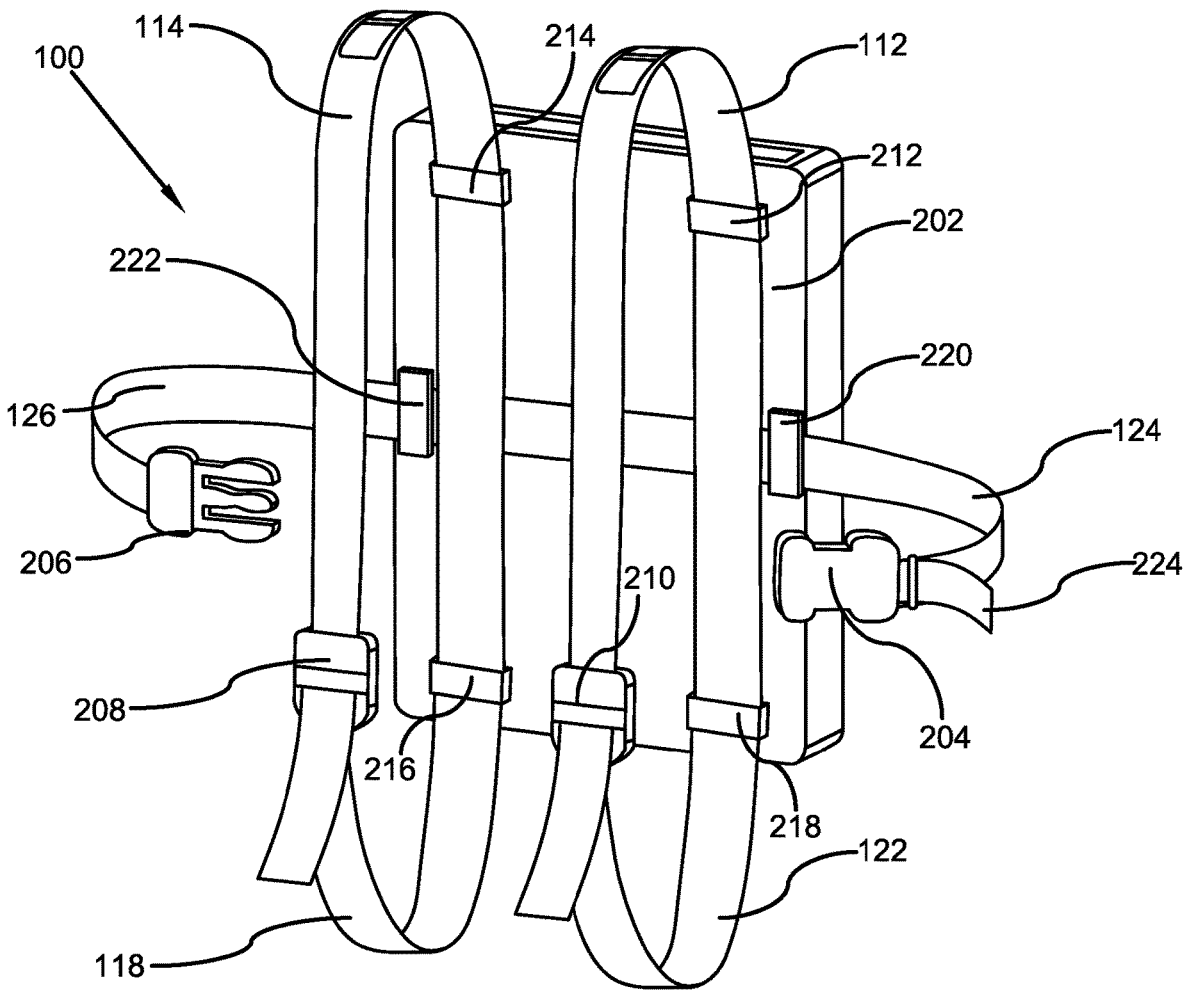
FIG. 2 illustrates a rear perspective view of the multipurpose tablet holding device of the present invention in accordance with the disclosed architecture.
Figure 5:
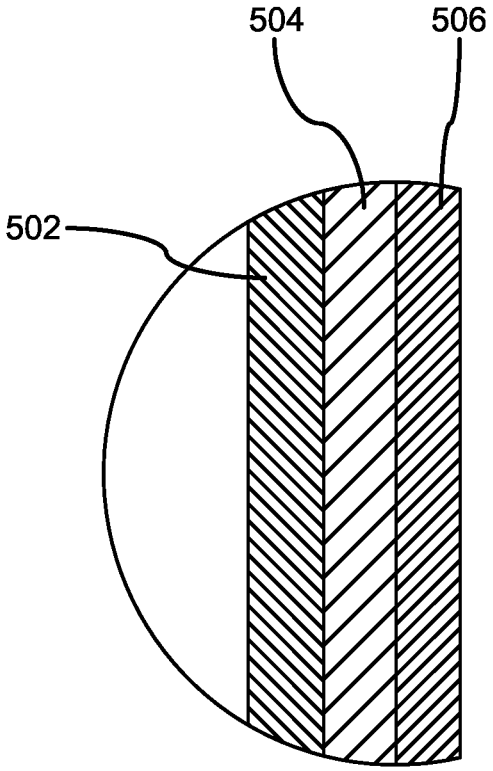
FIG. 5 illustrates a cross sectional view of the padded or impact absorbent case used in the electronic tablet holding apparatus of the present invention in accordance with the disclosed architecture.

For additional support in securing the holding device 100 to the body of a user, a pair of back support straps 124, 126 configured to fasten using buckles around the back of the user are provided. The straps 124, 126 have the fastening buckle as illustrated in FIG. 2 and can be adjusted in length to accommodate individuals of different body types. It should be noted that the padded or impact absorbent case 102 and the pockets 114, 116 include a plastic underlayer (as illustrated in FIG. 5) to maintain water-resistant protection and ensure tablets and documents are not damaged while wearing the system. The straps of the device 100 are made from one or more of nylon webbing, polyester, Dyneme, leather, vinyl, rubber, and a combination thereof.

The padded or impact absorbent case 102 is specially sized and designed to accommodate different tablets provided in the correction facilities and prisons. The device 100 enables a user to keep the personal documents and the tablet close to the body while doing any activity. The holding device 100 further protects the tablet and other documents from inclement weather and physical damage.

FIG. 2 illustrates a rear perspective view of the multipurpose tablet holding device 100 of the present invention in accordance with the disclosed architecture. In one embodiment of the present invention, the shoulder strap 112 and the bottom strap 122 are integrated together at the rear surface 202 of the padded or impact absorbent case. Similarly, the shoulder strap 114 and the bottom strap 118 are also integrated together at the rear surface 202. However, in some other embodiments of the present invention, the shoulder straps and the bottom straps are independent and can be individually adjusted in length.

The right shoulder strap 112 is sewn or attached to the rear surface 202 using sewn portion 212, and the left shoulder strap 114 is sewn using the corresponding sewn portion 214. The bottom straps 118, 122 are sewn to the rear surface 202 using the sewn elements 216, 218, respectively. The right shoulder strap 112 and the right bottom strap 122 are fastened together using the fastening buckle 210 enabling the device 100 to secure around the body a user. Similarly, the left shoulder strap 114 and the left bottom strap 118 are fastened together using the fastening buckle 208.

The back strap 124 is sewn to the rear surface 202 at the sewn portion 220 and has a buckle receiver 204 for accommodating the buckle 206 positioned at the free end of the other back strap 126 which is sewn at hook 222. While the back straps 124, 126 are fastened, they can overlap the fastened shoulder straps 112, 114 or alternatively, the shoulder straps may overlap the back straps 124, 126.

It should be appreciated that the plurality of straps positioned on the padded or impact absorbent case 102 enable the device 100 to be secured to the body, thereby preventing drops or physical damage thereto. Further, the rear surface 202 of the padded or impact absorbent case 102 may also have one or more pockets for storing one or more personal documents in accordance with the disclosed architecture. Further, all the straps are adjustable to accommodate users of different sizes. As illustrated, the free portion 224 of the back strap 124 can be pulled to adjust the length of the back strap 124.

Figure 3:
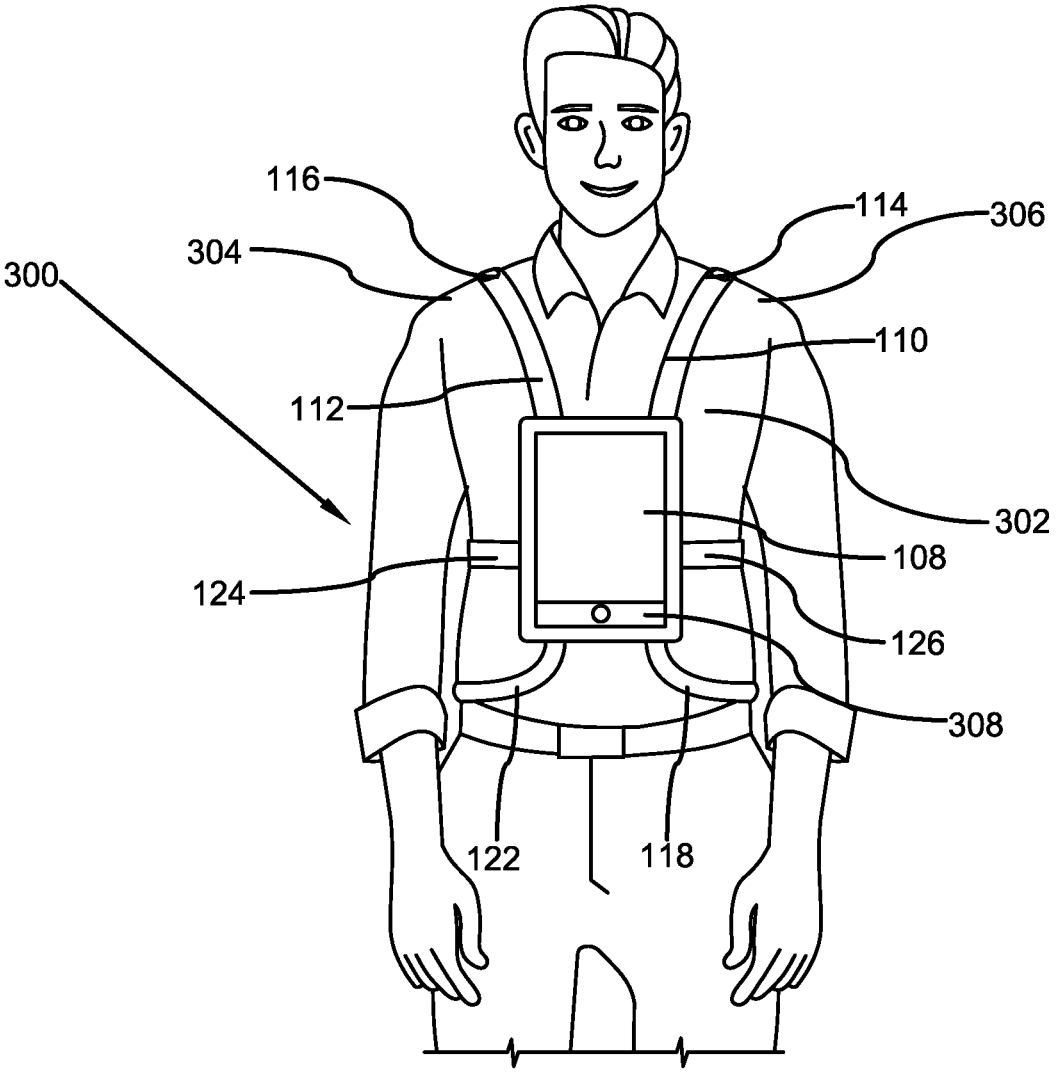
FIG. 3 illustrates a front perspective of a user wearing the electronic tablet holding apparatus of the present invention in accordance with the disclosed architecture.

FIG. 3 illustrates a front perspective of a user wearing the electronic tablet holding apparatus 100 of the present invention in accordance with the disclosed architecture. As illustrated, when the user 300 wears the device 100 on the body in the manner described in other embodiments of the present invention, the padded or impact absorbent case 102 rests on or below the chest 302 of the user 300 such that the user 300 can easily store or access the smart device, tablet, documents, and the like without removing the apparatus 100.

The right shoulder strap 112 goes over the right shoulder 304 from the front to the back of the user, and the left shoulder strap 114 goes over the left shoulder 306 from the front to the back of the user. The bottom straps 118, 122 go from the torso of the user to the back of the user to fasten to the shoulder straps as described in FIG. 2.

The smart device 308 is visible from outside through the clear front portion 108 such that the user is able to operate the smart device 308 without removing the tablet 308 from the padded or impact absorbent case 102. The back straps 124, 126 go around the back or rear of the user 300 and are fastened to secure the holding apparatus 100 to the body of the user 300.

FIG. 4 illustrates a rear perspective view of the user 300 wearing the electronic tablet holding apparatus 100 of the present invention in accordance with the disclosed architecture. As illustrated, the back straps 124, 126 are fastened using the buckle 206 and receiver 204 that are positioned at the back 402 of the user 300. The shoulder straps 112, 114 can include another buckle 212 and receiver 210 that are positioned at the back 402 of the user 300. The shoulder straps 112, 114 fasten to the bottom straps 122, 118 respectively, such that the padded or impact absorbent case 102 remains static and stable even in brisk motion and physical activities performed by the user 300.

FIG. 5 illustrates a cross sectional view of the padded or impact absorbent case used in the electronic tablet holding apparatus of the present invention in accordance with the disclosed architecture. The innermost layer 502 is made of thin and soft padded or impact absorbent such that the padded or impact absorbent case 102 remains soft and does not tarnish the clothes. The innermost layer 502 is woven and can come in different colors. The middle layer 504 is a water-resistant layer that protects the document and the stored tablet or smart device from weather elements. The outermost layer 506 is of water-resistant padded or impact absorbent and is woven in a mesh form. All the layers are sewn or glued together such that the clear plastic cover for displaying screen of the accommodated tablet is easily sewn to the layers.

Figure 6:
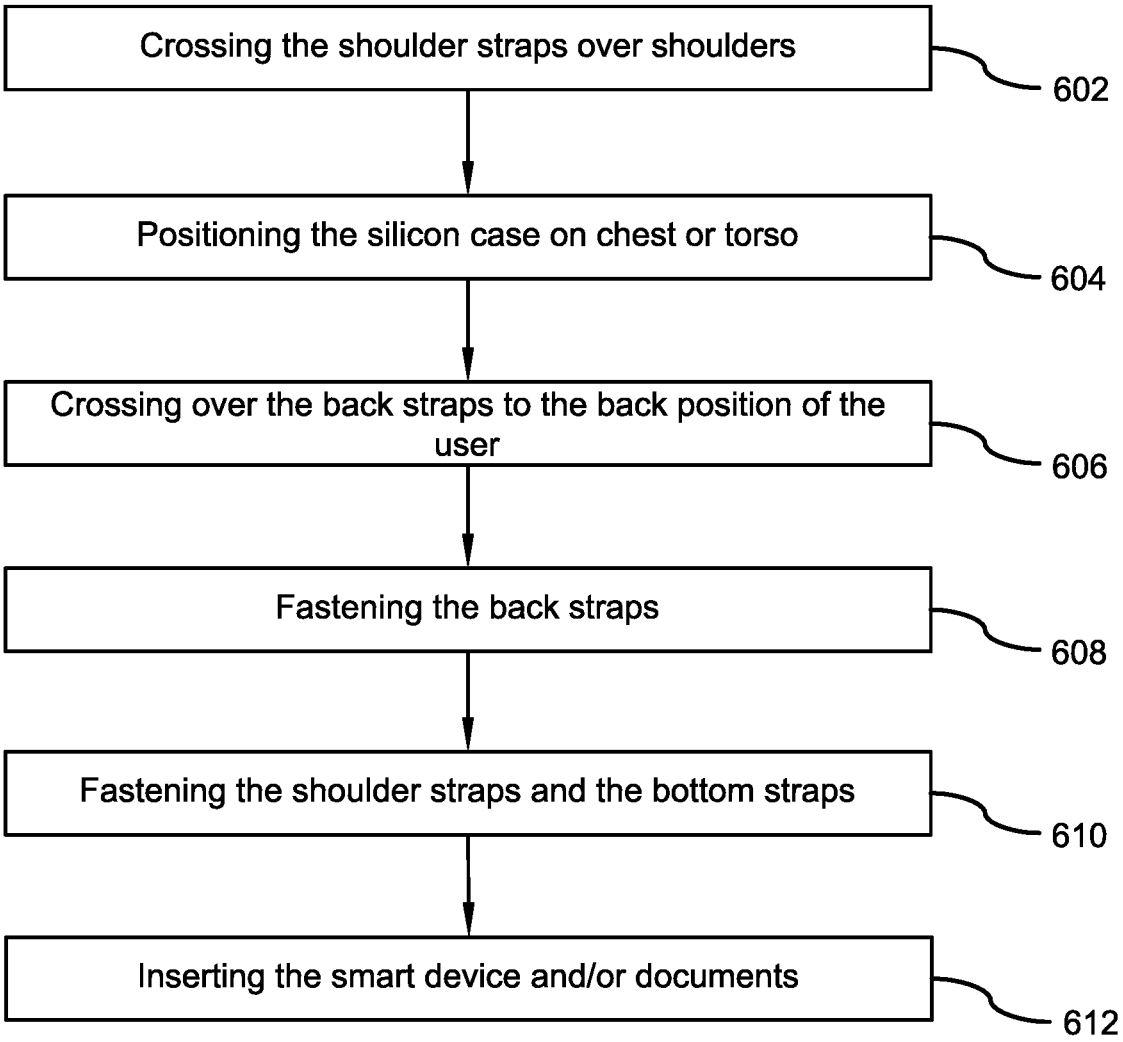
FIG. 6 illustrates a flow diagram depicting a process of wearing and using the multipurpose smart device holding apparatus of the present invention in accordance with the disclosed architecture.

FIG. 6 illustrates a flow diagram depicting a process of wearing and using the multipurpose smart device holding apparatus of the present invention in accordance with the disclosed architecture. Initially, the shoulder straps of the apparatus are crossed over the shoulders such that the pockets are positioned on the shoulders of a wearer (Step 602). Then, the shoulder straps are adjusted such that the padded or impact absorbent case is positioned on the chest or torso of the wearer (Step 604). Then, for securing the padded or impact absorbent case, the back straps are crossed from the sides of the wearer to the back of the wearer (Step 606) and are fastened using the buckle and receiver (Step 608). Thereafter, for stabilizing the padded or impact absorbent case and preventing the apparatus from falling, the shoulder straps and the bottom straps are fastened at the back of the wearer (Step 610). Finally, a smart device or tablet is inserted or accessed from the padded or impact absorbent case as per preferences of the wearer (Step 612).

Figure 7:
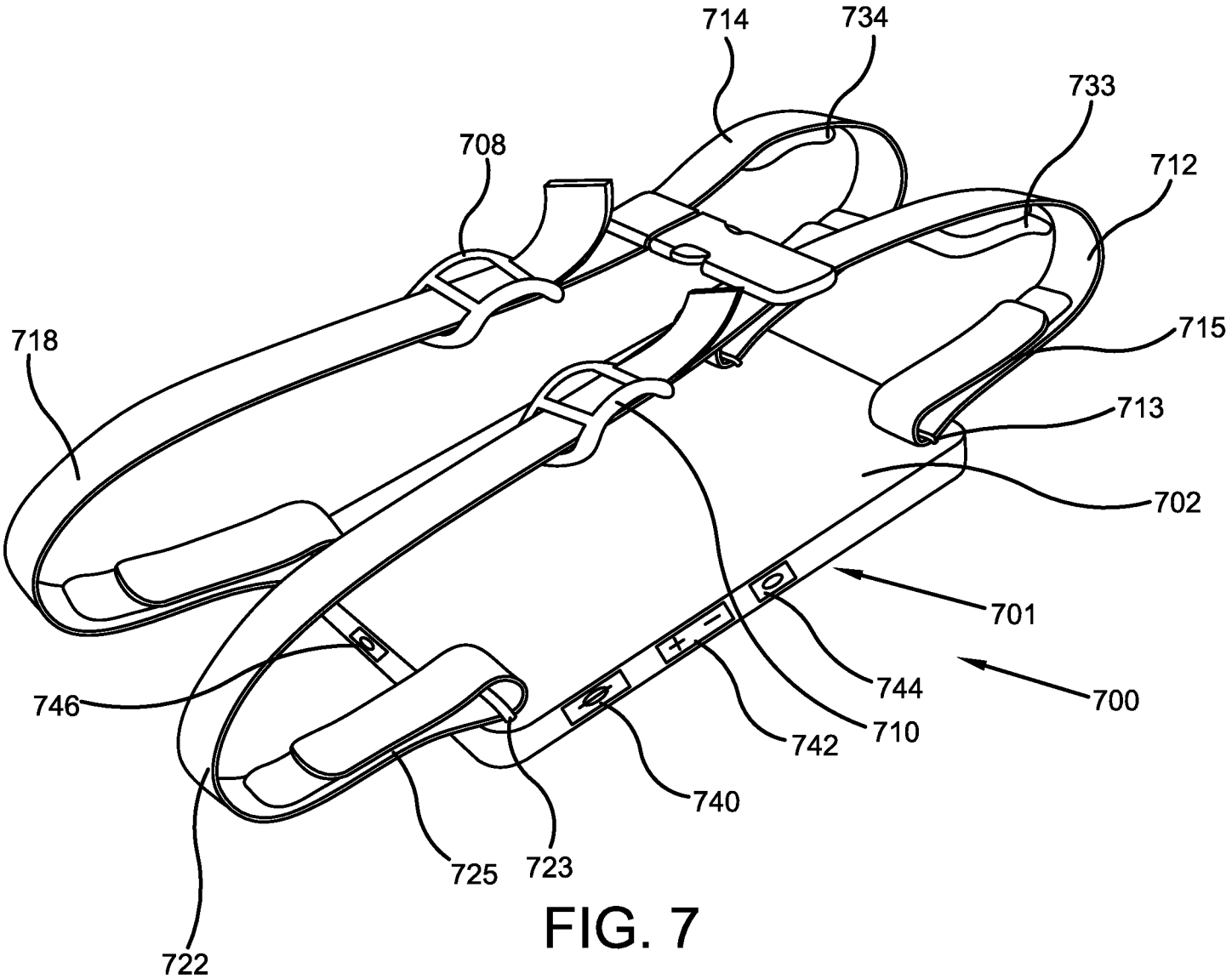
FIG. 7 illustrates a rear perspective view of another embodiment of a multipurpose tablet holding device of the present invention in accordance with the disclosed architecture.

FIG. 7 illustrates a perspective view of another embodiment of the multipurpose tablet holding device 700 of the present invention in accordance with the disclosed architecture. In the present embodiment of the present invention, an integrated shoulder strap 712 and bottom strap 722 are mounted to opposing slots 713, 723, respectively, at the rear surface 702 of the padded or impact absorbent case 701. Similarly, an integrated shoulder strap 714 and bottom strap 718 are mounted to opposing slots (not illustrated) at the rear surface 702 of the case. However, in some other embodiments of the present invention, the shoulder straps 712, 714 and the bottom straps 722, 718 are independent and can be individually adjusted in length.

The right shoulder strap 712 is attached to the rear surface 702 using an end portion lopped through slot 713 and secured with a hook and loop connection 715, and the left shoulder strap 714 is attached to the rear surface 702 using an end portion lopped through a rear slot and secured with a hook and loop connection (not illustrated). The bottom strap 722 is attached to the rear surface 702 using and end portion looped through slot 723 and secured with a hook and loop connection 725. The bottom strap 718 can be similarly secured to the rear surface 702 as bottom strap 722 (not illustrated). The right shoulder strap 712 and the right bottom strap 722 are fastened together using a fastening buckle 710 enabling the device 700 to secure around the body a user. Similarly, the left shoulder strap 714 and the left bottom strap 718 are fastened together using a fastening buckle 708.

It should be appreciated that the plurality of straps positioned on the padded or impact absorbent case 701 enable the device 700 to be secured to the body, thereby preventing drops or physical damage thereto. Further, the shoulder straps 712, 714 can include removable shoulder pads 732, 734. Further, all the straps are adjustable to accommodate users of different sizes. The case 701 can include sealable openings and controls for a power button 740, a volume control 742, a headphone port 744, and a charging port 746.

Figure 8:
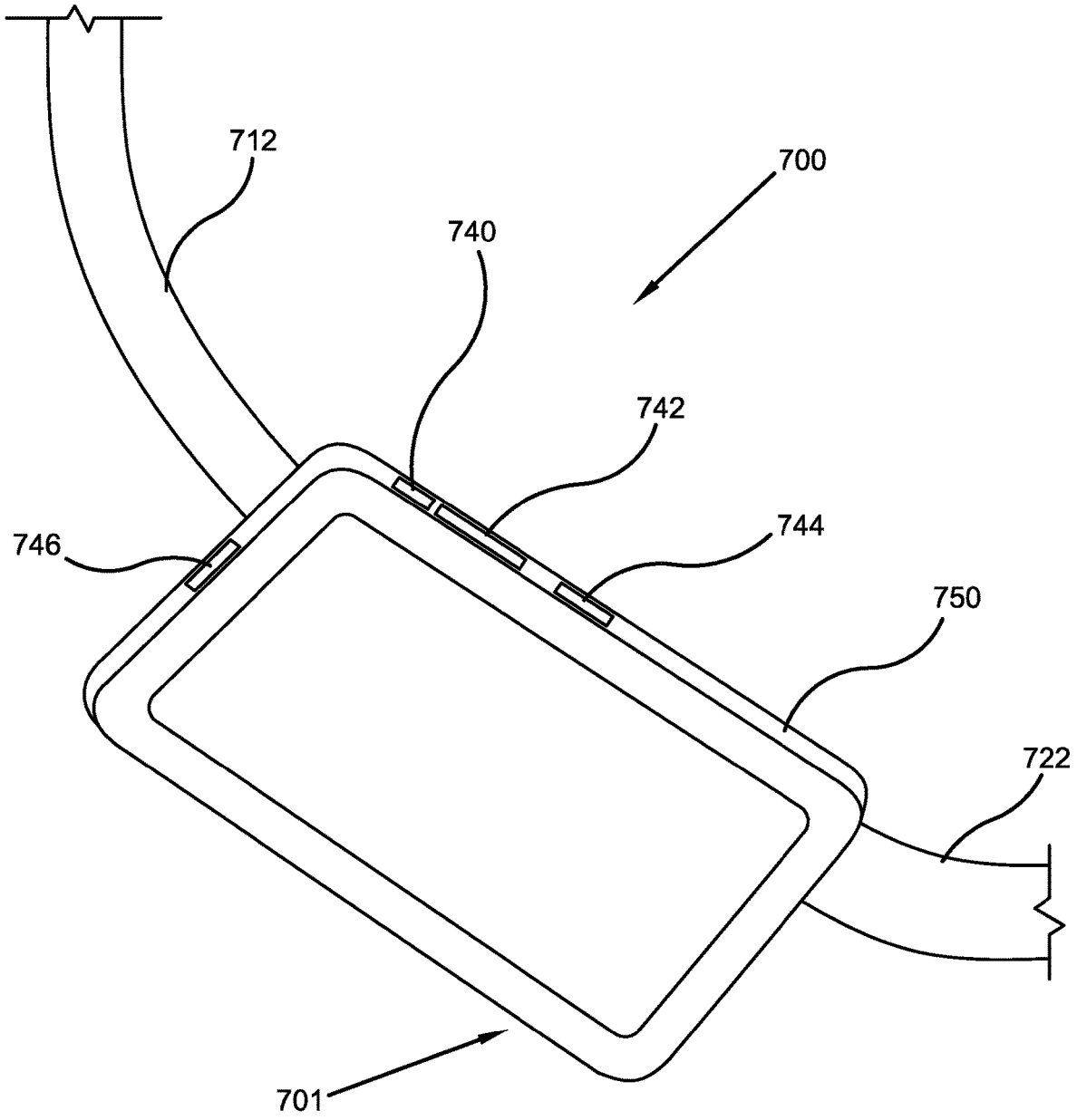
FIG. 8 illustrates a perspective view of a user wearing the another embodiment of the electronic tablet holding apparatus in one orientation in accordance with the disclosed architecture.
Figure 9:
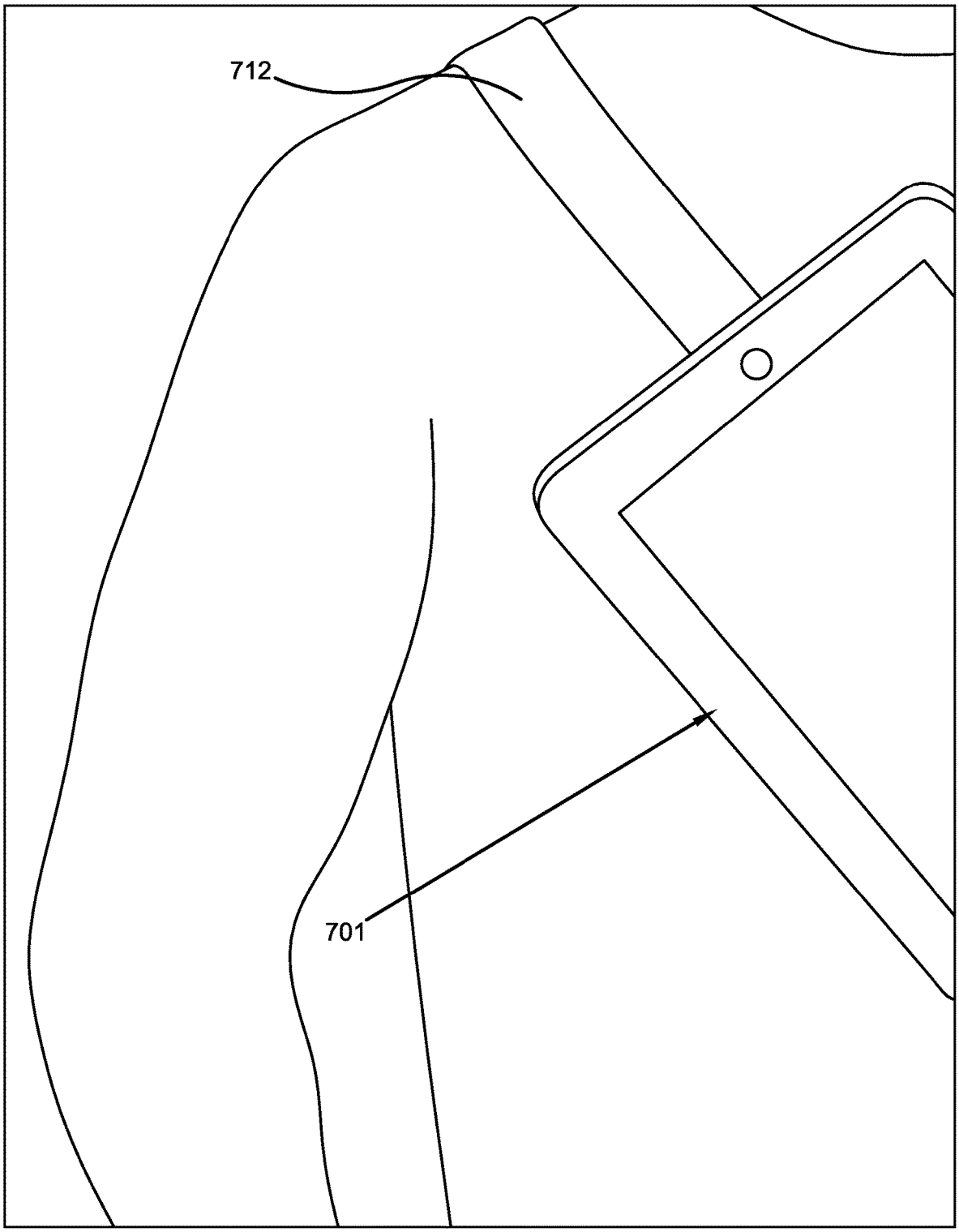
FIG. 9 illustrates a perspective view of a user wearing the electronic tablet holding apparatus in another orientation in accordance with the disclosed architecture.

FIGS. 8 and 9 illustrate perspective views of securing case 701 to the user in a sling or satchel configuration with only one shoulder strap 712 and one bottom strap 722 connected to opposing slots 713, 723 proximal to an edge 750 of case 701 (FIG. 8). Alternatively, the case 701 can be secured to the user in a sling or satchel configuration with only one shoulder strap 712 and one bottom strap connected to opposing centered slots (FIG. 9).

Certain terms are used throughout the following description and claims to refer to particular features or components. As one skilled in the art will appreciate, different persons may refer to the same feature or component by different names. This document does not intend to distinguish between components or features that differ in name but not structure or function. As used herein "tablet holding apparatus", "multipurpose tablet holding device", "prison tablet holding apparatus", "device", and "apparatus" are interchangeable and refer to the multipurpose tablet holding device 100 of the present invention.

Notwithstanding the foregoing, the multipurpose tablet holding device 100 of the present invention can be of any suitable size and configuration as is known in the art without affecting the overall concept of the invention, provided that it accomplishes the above-stated objectives. One of ordinary skill in the art will appreciate that the multipurpose tablet holding device 100 as shown in the FIGS. are for illustrative purposes only, and that many other sizes and shapes of the multipurpose tablet holding device 100 are well within the scope of the present disclosure. Although the dimensions of the multipurpose tablet holding device 100 are important design parameters for user convenience, the multipurpose tablet holding device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. An electronic tablet holding apparatus comprising:

an electronic tablet holding device having a plurality of straps to wrap around a body of a user and an impact absorbent case including a transparent front surface for holding a tablet close to a user's body;

wherein said impact absorbent case having a slit at a top end for inserting said tablet therethrough;

wherein said transparent front surface for viewing and accessing said electronic tablet therethrough;

wherein said plurality of straps having a right shoulder strap and a left shoulder strap attached to said top end of said impact absorbent case configured to extend said right shoulder strap over a right shoulder and to extend said left shoulder strap over a left shoulder;

wherein said right shoulder strap having a cushioned shoulder pocket and said left shoulder strap having a cushioned shoulder pocket;

wherein said right shoulder strap and said left shoulder strap are adjustable in length to fit around shoulders of different sized users;

wherein said plurality of straps having a right bottom strap and a left bottom strap attached to a bottom end of said impact absorbent case;

wherein said right bottom strap is adjustable in length and configured to releasably fasten to said right shoulder strap;

wherein said left bottom strap is adjustable in length and configured to releasably fasten to said left shoulder strap;

wherein said plurality of straps having a pair of adjustable back support straps attached to opposing sides of said impact absorbent case and extending generally horizontally around the back of the user;

wherein said pair of adjustable back support straps including a first buckle to fasten said pair of adjustable back support straps to a torso of the user;

wherein said impact absorbent case comprises a thin padded woven inner layer, a water-resistant middle layer, and a woven mesh impact absorbent outer layer; and wherein the plurality of straps are Dyneme straps.

2. The electronic tablet holding apparatus of claim 1, wherein said tablet is a GTL tablet.

3. The electronic tablet holding apparatus of claim 1, wherein said right shoulder strap and said right bottom strap fastened together with a second buckle at a rear surface of said impact absorbent case.

4. The electronic tablet holding apparatus of claim 3, wherein said left shoulder strap and said left bottom strap fastened together with a third fastening buckle at said rear surface of said impact absorbent case.

5. The electronic tablet holding apparatus of claim 4, wherein a portion of said right shoulder strap attached to said rear surface of said impact absorbent case and a portion of said left shoulder strap attached to said rear surface of said impact absorbent case.

6. The electronic tablet holding apparatus of claim 5, wherein fastened said adjustable back support straps overlap said right shoulder strap and said left shoulder strap.

7. The electronic tablet holding apparatus of claim 5, wherein fastened said right shoulder strap and said left shoulder strap overlap said adjustable back support straps.

8. The electronic tablet holding apparatus of claim 6, wherein said adjustable back support straps having a free end for pulling to adjust a length of said adjustable back support straps.

9. The electronic tablet holding apparatus of claim 8, wherein a fastened said impact absorbent case resting on a chest of the user.

10. The electronic tablet holding apparatus of claim 9, wherein said tablet operable through said transparent front surface.

11. An electronic tablet holding apparatus comprising:

an electronic tablet holding device having a plurality of straps to wrap around a body of a user and an impact absorbent case including a transparent front surface for holding a tablet close to a user's body;

wherein said impact absorbent case having a slit at a top end for inserting said tablet therethrough;

wherein said transparent front surface for viewing and accessing said electronic tablet therethrough;

wherein said plurality of straps having a right shoulder strap and a left shoulder strap attached to said top end of said impact absorbent case configured to extend said right shoulder strap over a right shoulder and to extend said left shoulder strap over a left shoulder;

wherein said right shoulder strap and said left shoulder strap are adjustable in length to fit around shoulders of different sized users;

wherein said plurality of straps having a right bottom strap and a left bottom strap attached to a bottom end of said impact absorbent case;

wherein said right bottom strap is adjustable in length and configured to releasably fasten to said right shoulder strap;

wherein said left bottom strap is adjustable in length and configured to releasably fasten to said left shoulder strap;

wherein said plurality of straps having a pair of adjustable back support straps attached to opposing sides of said impact absorbent case and extending generally horizontally around the back of the user;

wherein said pair of adjustable back support straps including a first buckle to fasten said pair of adjustable back support straps to a torso of the user;

wherein said right shoulder strap and said right bottom strap fastened together with a second buckle at a rear surface of said impact absorbent case;

wherein said left shoulder strap and said left bottom strap fastened together with a third fastening buckle at said rear surface of said impact absorbent case;

wherein said right shoulder strap having a cushioned shoulder pocket and said left shoulder strap having a cushioned shoulder pocket;

wherein the plurality of straps are rubber straps;

wherein said impact absorbent case further comprises a thin padded woven inner layer, a water-resistant middle layer, and a woven mesh impact absorbent outer layer; and wherein a back of the silicon case comprises a pair of slots, each slot configured to accept an end portion of the upper right and left shoulder straps respectively and a second pair of slots, each slot configured to accept an end portion of the lower right and left shoulder strap respectively and wherein the end portion of the right and left shoulder straps are securable within each respective slot via a hook and loop connection.

12. The electronic tablet holding apparatus of claim 11, wherein said tablet is a GTL tablet.

13. The electronic tablet holding apparatus of claim 11, wherein fastened said adjustable back support straps overlap said right shoulder strap and said left shoulder strap.

14. The electronic tablet holding apparatus of claim 11, wherein fastened said right shoulder strap and said left shoulder strap overlap said adjustable back support straps.

15. An electronic tablet holding apparatus comprising:

an electronic tablet holding device having a plurality of straps to wrap around a body of a user and a waterproof silicone case including a transparent front surface for holding a tablet close to a user's body;

wherein said silicone case having a slit at a top end for inserting said tablet therethrough;

wherein said transparent front surface for viewing and accessing said electronic tablet therethrough;

wherein said plurality of straps having a right shoulder strap and a left shoulder strap attached to said top end of said silicone case configured to extend said right shoulder strap over a right shoulder and to extend said left shoulder strap over a left shoulder;

wherein said right shoulder strap and said left shoulder strap are adjustable in length to fit around shoulders of different sized users;

wherein said plurality of straps having a right bottom strap and a left bottom strap attached to a bottom end of said silicone case;

wherein said right bottom strap is adjustable in length and configured to releasably fasten to said right shoulder strap;

wherein said left bottom strap is adjustable in length and configured to releasably fasten to said left shoulder strap;

wherein said plurality of straps having a pair of adjustable back support straps attached to opposing sides of said silicone case and extending generally horizontally around the back of the user;

wherein said pair of adjustable back support straps including a first buckle to fasten said pair of adjustable back support straps to a torso of the user;

wherein said right shoulder strap and said left shoulder strap including a second buckle to fasten said right shoulder strap and said left shoulder strap to the torso of the user;

wherein said right shoulder strap and said right bottom strap fastened together with a third buckle at a rear surface of said silicone case;

wherein said left shoulder strap and said left bottom strap fastened together with a fourth fastening buckle at said rear surface of said silicone case;

wherein a fastened said silicone case resting on a chest of the user;

wherein said tablet operable through said transparent front surface;

wherein the silicon case further comprises a plurality of sealable openings; and wherein the plurality of straps are leather straps; and wherein a back of the silicon case comprises a pair of slots, each slot configured to accept an end portion of the upper right and left shoulder straps respectively and a second pair of slots, each slot configured to accept an end portion of the lower right and left shoulder strap respectively and wherein the end portion of the right and left shoulder straps are securable within each respective slot via a hook and loop connection.

* * * * *